US010287814B2

(12) United States Patent
Fortin

(10) Patent No.: US 10,287,814 B2
(45) Date of Patent: May 14, 2019

(54) PULLEY RIVET FOR INSTALLATION OF PULLEYS FOR WINDOW REGULATOR SYSTEMS

(71) Applicant: Magna Closures Inc., Newmarket (CA)

(72) Inventor: Raymond Edward Fortin, Newmarket (CA)

(73) Assignee: Magna Closures Inc., Newmarket (CA)

( * ) Notice: Subject to any disclaimer, the term of this patent is extended or adjusted under 35 U.S.C. 154(b) by 0 days.

(21) Appl. No.: 15/598,467

(22) Filed: May 18, 2017

(65) Prior Publication Data

US 2017/0342756 A1 Nov. 30, 2017

Related U.S. Application Data

(60) Provisional application No. 62/341,317, filed on May 25, 2016.

(51) Int. Cl.

| | |
|---|---|
| ***E05F 11/48*** | (2006.01) |
| ***E05F 15/689*** | (2015.01) |
| ***E05D 15/16*** | (2006.01) |
| *B21J 15/28* | (2006.01) |

(52) U.S. Cl.

CPC ..... *E05F 11/488* (2013.01); *E05D 15/165* (2013.01); *E05F 11/485* (2013.01); *E05F 15/689* (2015.01); *B21J 15/285* (2013.01); *E05Y 2201/684* (2013.01)

(58) Field of Classification Search

CPC ..... E05F 1/488; E05F 1/485; E05F 15/689; E05D 15/165; E05Y 2201/684

USPC ..... 49/352

See application file for complete search history.

(56) References Cited

U.S. PATENT DOCUMENTS

| | | | | |
|---|---|---|---|---|
| 5,333,411 | A * | 8/1994 | Tschirschwitz | E05F 11/486 49/352 |
| 6,571,515 | B1 * | 6/2003 | Samways | B60J 5/0416 49/352 |
| 9,388,882 | B2 * | 7/2016 | Takano | F16H 7/12 |
| 9,580,953 | B1 * | 2/2017 | Matsushita | E05F 15/689 |
| 9,702,399 | B2 * | 7/2017 | Arnault | F16C 13/006 |
| 9,707,827 | B2 * | 7/2017 | Kroack | E05F 11/382 |
| 9,752,662 | B2 * | 9/2017 | Takano | F16H 7/1281 |

(Continued)

*Primary Examiner* — Jerry E Redman

(74) *Attorney, Agent, or Firm* — Grant Tisdall

(57) ABSTRACT

A component for a window regulator system of a vehicle closure panel including: a rail having a rail aperture extending between a first side of the rail and a second side opposite the first side, the rail aperture having a retaining surface associated with the rail aperture; a pulley for mounting adjacent to the first side, the pulley having a pulley aperture with a pulley surface opposite the first side; a pulley rivet having a rivet body including a retaining lip for engaging with the pulley surface and a retainer portion for engaging with the retaining surface, the rivet body configured for receipt in both the pulley aperture and the rail aperture when installed, the rivet body having a hole for receiving a fastener for fastening the rail to a panel via the pulley rivet; wherein, when installed, the rivet body is positioned within the pulley aperture and within the rail aperture, such that engagement between the retaining lip and the pulley surface inhibits separation of the pulley from the rail while engagement of the retainer portion with the retaining surface inhibits separation of the pulley rivet from the rail aperture.

12 Claims, 5 Drawing Sheets

(56) References Cited

U.S. PATENT DOCUMENTS

| | | | | |
|---|---|---|---|---|
| 9,896,874 | B2 * | 2/2018 | Chono | E05F 15/689 |
| 2009/0051193 | A1 * | 2/2009 | Hernandez | B60J 5/0416 296/146.2 |
| 2009/0188167 | A1 * | 7/2009 | Maruyama | E05F 11/483 49/347 |
| 2011/0010999 | A1 * | 1/2011 | Broadhead | B60J 5/0416 49/352 |
| 2011/0078957 | A1 * | 4/2011 | Deschner | B60J 5/0416 49/352 |
| 2011/0111900 | A1 * | 5/2011 | Wilson | F16C 13/006 474/166 |
| 2014/0179475 | A1 * | 6/2014 | Fukumoto | E05F 11/483 474/166 |
| 2015/0191957 | A1 * | 7/2015 | Takeda | E05F 11/483 49/352 |
| 2015/0275560 | A1 * | 10/2015 | Yamamoto | E05F 11/488 49/352 |

* cited by examiner

PULLEY RIVET FOR INSTALLATION OF PULLEYS FOR WINDOW REGULATOR SYSTEMS

FIELD

The present disclosure relates to window regulator systems.

BACKGROUND

Vehicle doors have windows that can be opened and closed. Within the door, there can be a window regulator assembly including a carrier panel, a motor, rails and window regulator lifter or carrier plate assembly which is driven along is respective rail by the motor with associated cabling. There are several problems, however, with these window regulator assemblies. For example, in situations where the window regulator lifter assemblies are driven by cables, pulleys can be are used to effect a change in direction for the cables within the regulator assembly. However, due to forces involved in operating and/or in installing the window regulator assembly, the joint between the pulleys and the carrier may be subject to premature failure.

It is recognized that window regulator systems can be fastened to the interior of the vehicle doors in a variety of different ways. It is advantageous for such fastening systems to be streamlined in design as well as to be strong enough to withstand cable tension forces during installation and/or operation.

SUMMARY

It is an object of the present invention to provide a pulley installation on a window regulator system component to obviate or mitigate at least some of the above-presented disadvantages.

An aspect provided is a component for a window regulator system of a vehicle closure panel including: a rail having a rail aperture extending between a first side of the rail and a second side opposite the first side, the rail aperture having a retaining surface associated with the rail aperture; a pulley for mounting adjacent to the first side, the pulley having a pulley aperture with a pulley surface opposite the first side; a pulley rivet having a rivet body including a retaining lip for engaging with the pulley surface and a retainer portion for engaging with the retaining surface, the rivet body configured for receipt in both the pulley aperture and the rail aperture when installed, the rivet body having a hole for receiving a fastener for fastening the rail to a panel via the pulley rivet; wherein, when installed, the rivet body is positioned within the pulley aperture and within the rail aperture, such that engagement between the retaining lip and the pulley surface inhibits separation of the pulley from the rail while engagement of the retainer portion with the retaining surface inhibits separation of the pulley rivet from the rail aperture.

A further aspect provided a pulley rivet having a rivet body including a retaining lip for engaging with a pulley surface and a retainer portion for engaging with a retaining surface, the rivet body configured for receipt in both a pulley aperture and a rail aperture when installed, the rivet body having a hole for receiving a fastener for fastening the rail to a panel via the pulley rivet; wherein, when installed, the rivet body is positioned within the pulley aperture and within the rail aperture, such that engagement between the retaining lip and the pulley surface inhibits separation of the pulley from the rail while engagement of the retainer portion with the retaining surface inhibits separation of the pulley rivet from the rail aperture.

BRIEF DESCRIPTION OF THE DRAWINGS

The foregoing and other aspects will now be described by way of example only with reference to the attached drawings, in which.

DETAILED DESCRIPTION

Figure 1:
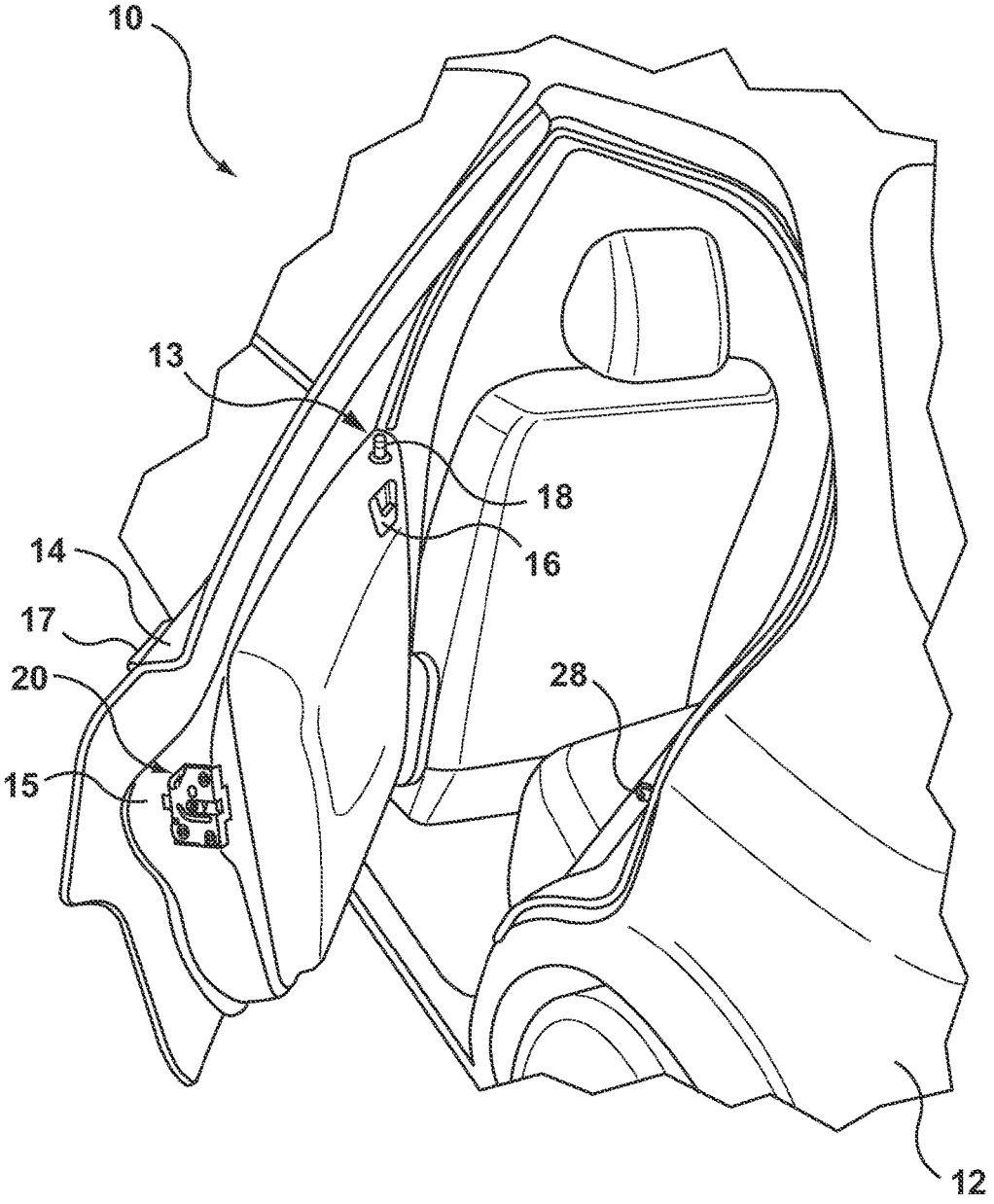
FIG. 1 is a perspective view of a vehicle.

FIG. 1 is a perspective view of a vehicle 10 that includes a vehicle body 12 and at least one vehicle door 14 (also referred to as a closure panel 14). The vehicle door 14 includes a latch 20 that is positioned on a frame 15 of the vehicle door 14, the latch 20 releasably engageable with a striker 28 on the vehicle body 12 to releasably hold the vehicle door 14 in a closed position. The frame 15 also supports a window 13 via a window regulator assembly (not shown) mounted to the frame 15, as further described below. An outside door handle 17 is provided for opening the latch 20 (i.e. for releasing the latch 20 from the striker 28) to open the vehicle door 14, as well as optionally to operate the window regulator system. Further, the vehicle door 14 has an inside control 16 (e.g. door handle, window controls, etc.) for operating the latch 20 and the window regulator assembly. A door panel 18 is shown providing a finishing cover (e.g. interior panel) over the window regulator assembly positioned between the frame 15 and the door panel 18.

For vehicles 10, the closure panel 14 can be referred to as a partition or door, typically hinged, but sometimes attached by other mechanisms such as tracks, in front of an opening which is used for entering and exiting the vehicle 10 interior by people and/or cargo. In terms of vehicles 10, the closure panel 14 may be a driver/passenger door, a lift gate, or it may be some other kind of closure panel 14, such as an upward-swinging vehicle door (i.e. what is sometimes referred to as a gull-wing door) or a conventional type of door that is hinged at a front-facing or back-facing edge of the door, and so allows the door to swing (or slide) away from (or towards) the opening in the body 12 of the vehicle 10. Also contemplated are sliding door embodiments of the closure panel 14 and canopy door embodiments of the closure panel 14, such that sliding doors can be a type of door that open by sliding horizontally or vertically, whereby the door is either mounted on, or suspended from a track that provides for a larger opening. Canopy doors are a type of door that sits on top of the vehicle 10 and lifts up in some way, to provide access for vehicle passengers via the opening (e.g. car canopy, aircraft canopy, etc.). Canopy doors can be connected (e.g. hinged at a defined pivot axis and/or connected for travel along a track) to the body 12 of the vehicle at the front, side or back of the door, as the application permits. It is recognized that the body 12 can be represented as a body panel of the vehicle 10, a frame of the vehicle 10, and/or a combination frame and body panel assembly, as desired.

Figure 2:
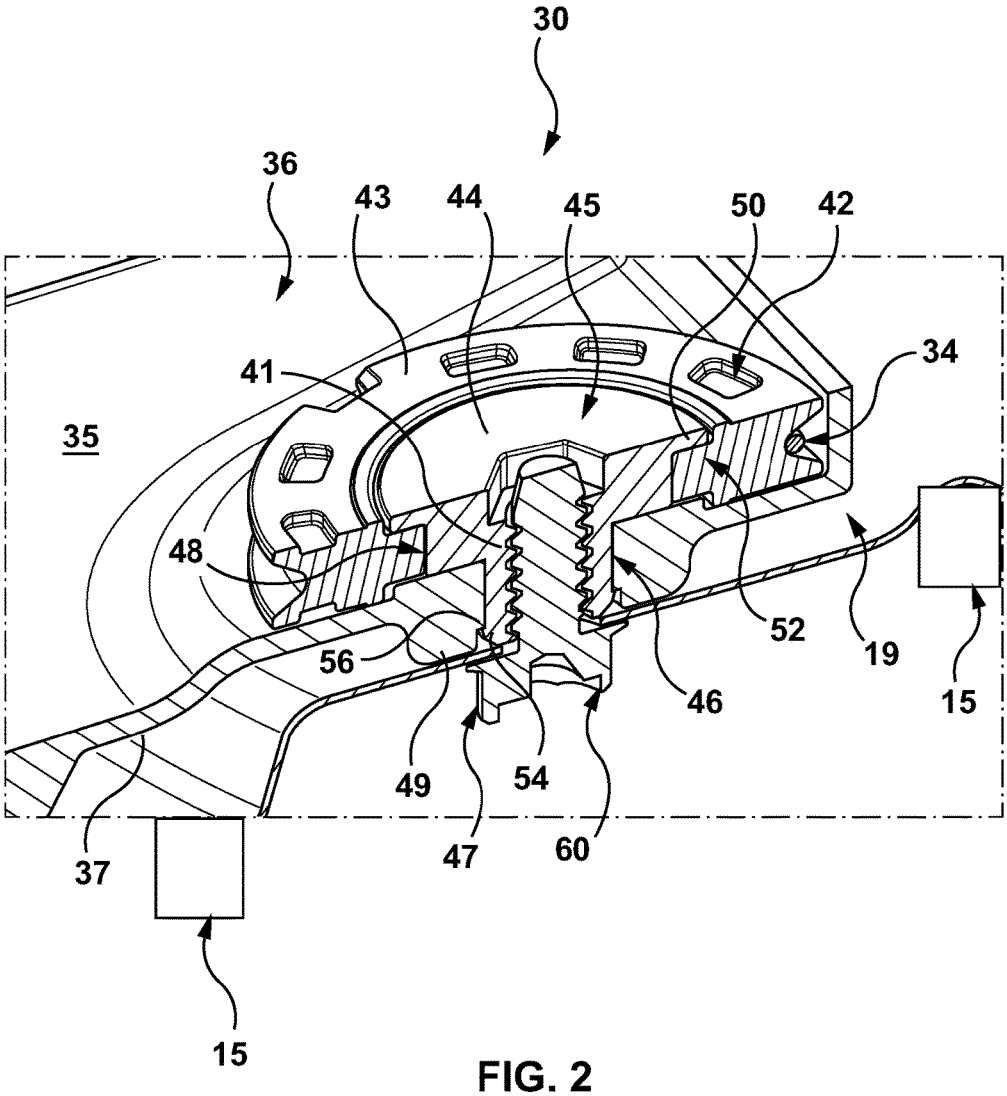
FIG. 2 is a perspective cross sectional view along line A-A of FIG. 4 and also showing as context a portion of the window regulator system shown in FIG. 1.
Figure 3:
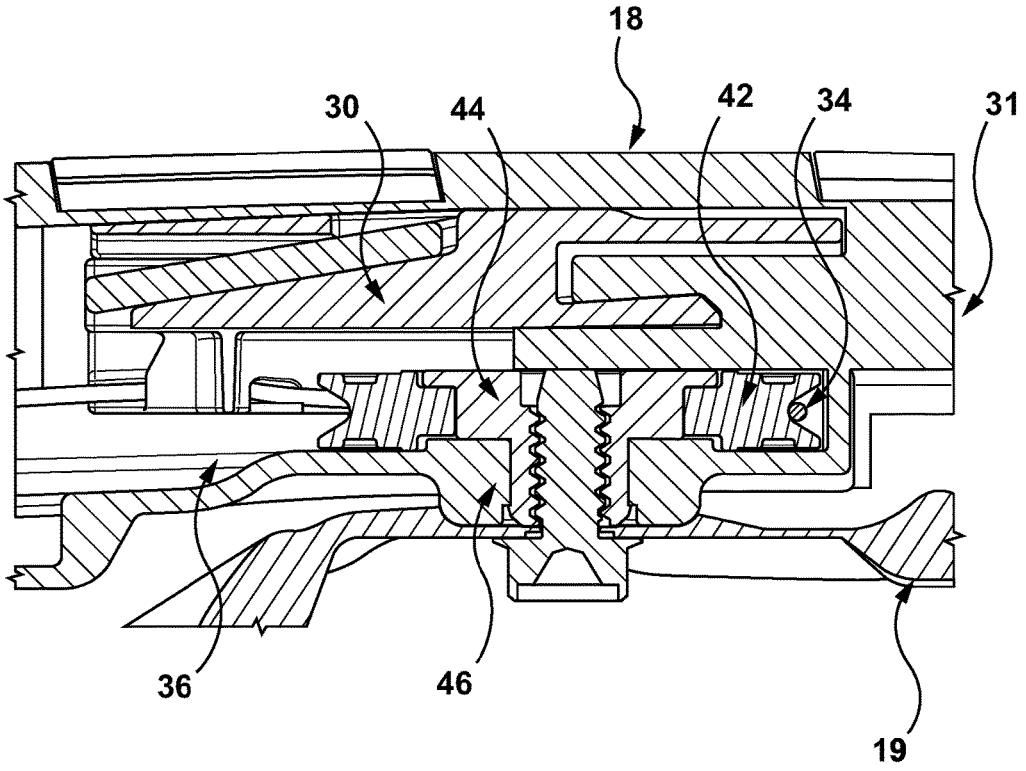
FIG. 3 is a further perspective cross sectional view along line A-A of FIG. 4 and also showing as context a portion of the window regulator system shown in FIG. 2.

In general, the window can be coupled to a window regulator assembly (not shown) for moving the vehicle window 13 up and down, i.e. in and out of the an enclosure 31 provided between the frame 15 and the door panel 18 (see FIG. 3). The window regulator assembly can include a drive motor and drive mechanism (e.g. gearing—not shown) connected to a set of drive cables (not shown), one or more rails 36 for mounting on the frame 15 (or on an intervening carrier panel 19 as desired—see FIG. 2), a regulator carriage (not shown) connected to the window 13 and mounted on the rail 36 for riding along a track, and one or more pulleys 42 (e.g. upper pulley and lower pulley) for effecting changes in direction of the drive cables. In operation of the window regulator assembly, the drive motor causes movement of the drive cables which in turn propels the regulator carriage towards one end or the other end of the rail 36, depending upon the rotational direction of the drive motor (e.g. as controlled by the door controls 16,17). It is recognized that the rails 36 can be mounted on the carrier panel 19 that is itself mounted to the frame 15, as shown in FIG. 2. Alternatively, the rails 36 can be mounted directly to the frame 15 (not shown) without the need for the intervening carrier panel 19.

Referring to FIG. 2, show is a perspective view of a cross section of the pulley 42 and associated attachment of the pulley 42 to the frame 15. A pulley rivet 44 connects the pulley 42 to an aperture 46 in the rail 36 via an aperture 48 in the pulley 42, such that a body 41 of the pulley rivet 44 extends from one side 43 of the pulley 42 facing the enclosure 31 (see FIG. 3) to the end 49 of the rail aperture 46 adjacent to the frame 15. It is recognized that the pulley 42 is positioned on an interior side 35 of the rail 36, and an exterior side 37 of the rail 36 is positioned adjacent to the frame 15.

The pulley rivet 44 has a retaining lip 50 on one side 45 that overlaps with a pulley surface 52 (e.g. a retaining surface for the retaining lip 50) of the pulley 42 adjacent to the aperture 48, in order to retain positioning of the pulley 42 adjacent to the rail 36 when installed by the pulley rivet 44 (i.e. adjacent to the interior side 35). At another side 47 of the pulley rivet 44, opposite the one side 45, can be an undercut (e.g. retainer portion) 54 for providing a snap fit against a corresponding retaining surface 56, for example, adjacent to the aperture 46 in the rail 36 (i.e. on the exterior side 37), the snap fit between the undercut 54 and the retaining surface 56 acting as a detent mechanism to retain the pulley rivet 44 within the aperture 46, once inserted. As such, the material (e.g. plastic) of the body 41 of the pulley rivet 44 is resilient to provide for deformation (e.g. elastic) of the body adjacent to the undercut 54 during travel of the pulley rivet 44 within (and through) the aperture 46, such that the undercut 54 overlaps the retaining surface 56 once the undercut 54 inserted in (and optionally emerges out of) the aperture 46. In other words, the body 41 (or portion thereof) of the pulley rivet 44 between the retaining lip 50 and the undercut 54 is of a cross sectional dimension smaller than a corresponding cross sectional dimension of the aperture 46, while the undercut 54 itself (e.g. a barb) is of a cross sectional dimension greater than the cross sectional dimension of the aperture 46 in order to provide for the overlap between the undercut 54 and the retaining surface 56 as shown in FIGS. 2 and 3. It is also recognized that the position of the retaining surface 56 can be other than shown. For example, the retaining surface 56 rather than being positioned external to the aperture 46 (i.e. on the surface 37 of the rail 36), the retaining surface 56 (or more than one retaining surface for mating with a corresponding number of undercuts 54—not shown) can be positioned within the aperture 46 and as such the body 41 of the pulley rivet 44 may not extend through the aperture 46. In other words, mating of the retaining surface 56 and the undercut 54 can occur within the aperture 46 rather than external to the aperture 46, such that the retaining surface 56 and the undercut 54 function as the detent mechanism.

Figure 4:
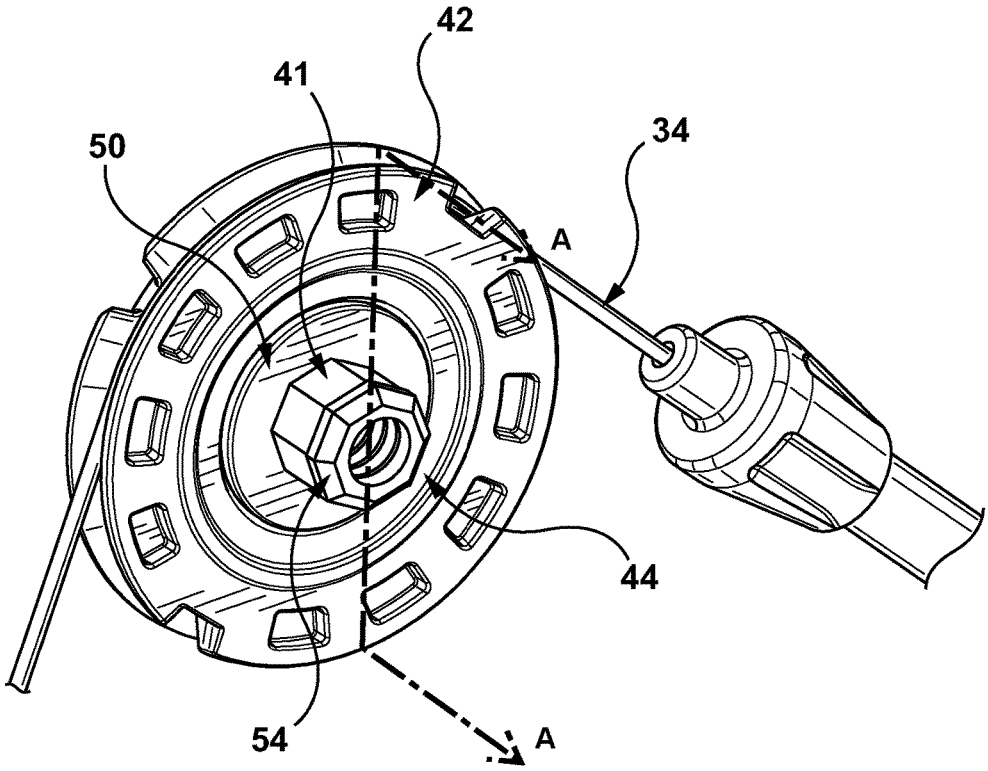
FIG. 4 is perspective view of a pulley rivet of the window regulator system shown in FIG. 2.

As shown in FIG. 4, the cross sectional shape of the body 41 portion of the pulley rivet 44 positioned within the aperture 46 (see FIG. 2) can be other than circular, e.g. hexagonal. As such, the cross sectional shape of non-circular (e.g. hexagonal, square, oval, etc.) can inhibit rotation of the pulley rivet 44 in the aperture 46 when under influence of rotation of the pulley 42 as the window regulator assembly is operated by the drive motor, recognizing that the cross sectional shape of the aperture 46 corresponds (e.g. similarly shaped) to that of the body 41 to facilitate the inhibiting of body 41 rotation within.

Figure 5:
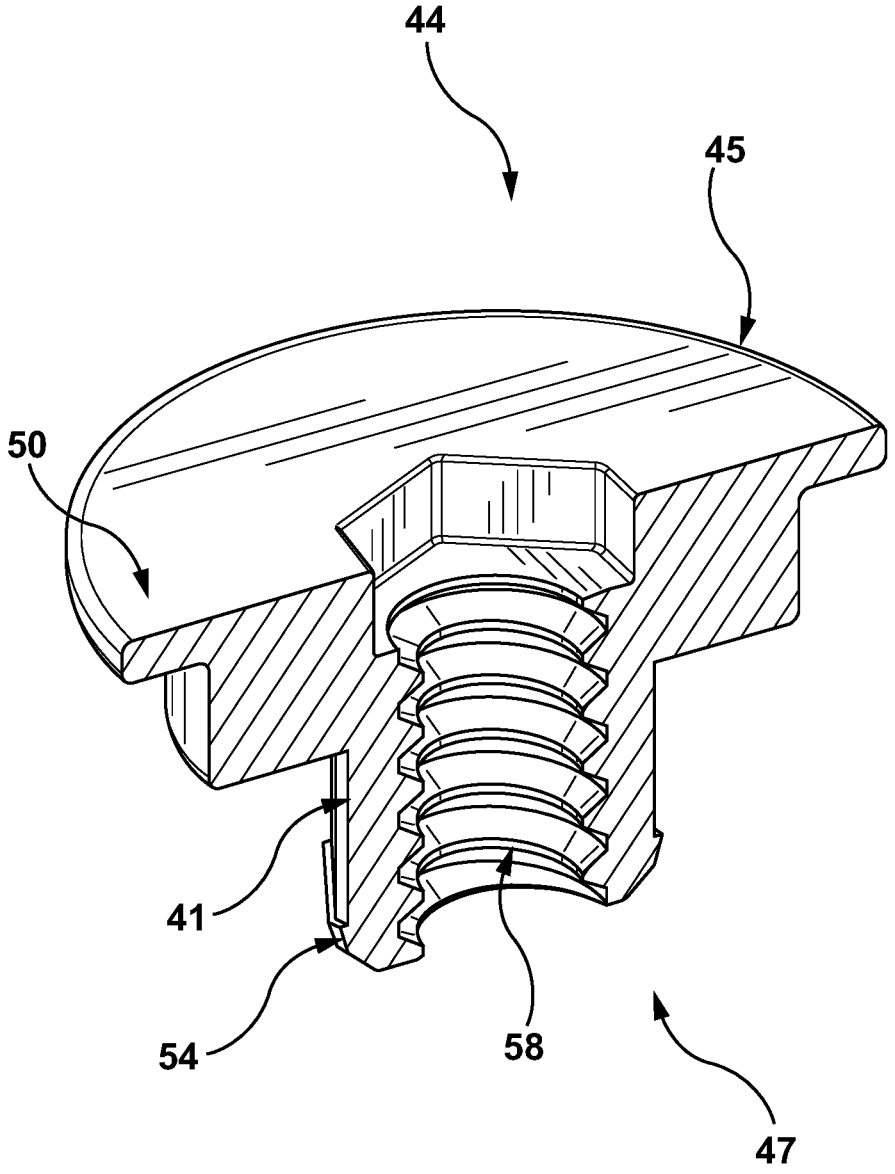
FIG. 5 is a cross sectional view of the pulley rivet along the line A-A of FIG. 4.

Referring to FIG. 5, shown is a hole 58 (e.g. extending from the one side 45 to the other side 47, or not extending there through as desired) positioned in the body 41 of the pulley rivet 44 between the one side 45 and the other side 47. A longitudinal axis of the hole 58 (in the body 41) can be aligned with a longitudinal axis of the rail aperture 46. Further, the longitudinal axis of the rail aperture 46 can be aligned with a longitudinal axis of the pulley aperture 48. For example, hole 58 in the rivet body 41 forms a tubular shaped wall about the longitudinal axis of the pulley rivet 44, such that the fastener 60 is positioned within the interior of the tubular shaped wall and the undercut 54 is located on the exterior of the tubular shaped wall. The hole 58 can be threaded, or otherwise, in order to receive a fastener 60 used to fixedly attach the pulley rivet 44 (once installed on the pulley 42 and rail 36) to the carrier panel 19 and/or frame 15 (see FIG. 2). Accordingly, by example, the fastener 60 can be a screw or a bolt and nut combination, as desired.

In operation of the pulley rivet 44, the pulley rivet 44 is placed through the aperture 48 of the pulley 42 such that the retaining lip 50 overlaps with the pulley surface 52. The body 41 of the pulley rivet 44 with the undercut 54 is then pushed into (and optionally though) the aperture 46 of the rail 36 until the undercut 54 overlaps the retaining surface 56 of the aperture 46, thus securing the pulley rivet 44 within the aperture 46 (through engagement of the retaining surface 56 with the undercut 54) and accordingly the pulley 42 on the rail 36 by means of the retaining lip 50 cooperating with the pulley surface 52. The pulley rivet 44 is inserted into (e.g. received by) both the rail aperture 46 and the pulley aperture 48 when the apertures 46, 48 are aligned. Once the rail 36 (with attached pulley 42) is in an assembly position with the carrier panel 16 (and/or frame 15), the installer can then insert the fastener through a hole in the carrier panel 16 (and/or frame 15) and then fasten the fastener 60 in the hole 58 of the pulley rivet 44, thus securing the rail 36 and attached pulley 42 thereto via the rivet pulley 44. It is recognized that some or all of the components of the window regulator system (e.g. one or more rails 36, the regulator carriage connected to the window 13 and mounted on the rail 36) is/are ultimately connected to the carrier panel 16 and/or frame 15 via cooperation of the pulley rivet 44 and the fastener 60. Preferably, the pulley rivet 44 is installed from the one side 35 of the rail 36 and the fastener 60 from the other side 37 of the rail 36. Once the fastener 60 is fastened in the hole 60, the window regulator system, if not already attached to the frame 15, can then be attached via the carrier panel 16 to the frame 15 by other fasteners as desired. It is recognized that the aperture 46 of the rail 36 can be aligned with the corresponding hole in the carrier panel 16 and/or frame 15 when inserting the fastener 60 into the hole 58 of the pulley rivet 44.

While the above description constitutes a plurality of embodiments, it will be appreciated that the present disclosure is susceptible to further modification and change without departing from the fair meaning of the accompanying claims.

I claim:

1. A component for a window regulator system of a vehicle closure panel including:

a rail having a rail aperture extending between a first side of the rail and a second side opposite the first side, the rail aperture having a retaining surface associated with the rail aperture;

a pulley mounted adjacent to the first side, the pulley having a pulley aperture with a pulley surface opposite the first side;

a pulley rivet having a rivet body including a retaining lip engaging with the pulley surface and a retainer portion engaging with the retaining surface, the rivet body received in both the pulley aperture and the rail aperture when installed, the rivet body having a hole receiving a fastener fastening the rail to a panel;

wherein, when installed, the rivet body is positioned within the pulley aperture and within the rail aperture, such that engagement between the retaining lip and the pulley surface inhibits separation of the pulley from the rail while engagement of the retainer portion with the retaining surface inhibits separation of the pulley rivet from the rail aperture and wherein the retainer portion directly engages the retaining surface.

2. The component of claim 1, wherein the retaining surface is adjacent to the second side.

3. The component of claim 1, wherein the panel is a carrier panel that is separate from a frame of the vehicle closure panel and suitable for mounting to the frame.

4. The component of claim 1, wherein the rivet body further includes the retainer portion as a resiliently mounted undercut for providing a snap fit with the rail when installed thereon.

5. The component of claim 4, wherein the undercut is positioned on the rivet body for engaging with an inside wall of the rail aperture.

6. The component of claim 4, wherein the undercut is positioned on the rivet body for engaging with the rail external to the rail aperture.

7. A component for a window regulator system of a vehicle closure panel including:

a rail having a rail aperture extending between a first side of the rail and a second side opposite the first side, the rail aperture having a retaining surface associated with the rail aperture;

a pulley mounted adjacent to the first side, the pulley having a pulley aperture with a pulley surface opposite the first side;

a pulley rivet having a rivet body including a retaining lip engaging with the pulley surface and a retainer portion engaging with the retaining surface, the rivet body received in both the pulley aperture and the rail aperture when installed, the rivet body having a hole receiving a fastener fastening the rail to a panel;

wherein, when installed, the rivet body is positioned within the pulley aperture and within the rail aperture, such that engagement between the retaining lip and the pulley surface inhibits separation of the pulley from the rail while engagement of the retainer portion with the retaining surface inhibits separation of the pulley rivet from the rail aperture.

8. The component of claim 7, wherein when installed, the retainer portion fits against and in contact with the retaining surface.

9. The component of claim 7, wherein the rivet body further includes the retainer portion as a resiliently mounted undercut for providing a snap fit with the rail when installed thereon such that the resiliently mounted undercut overlaps the retaining surface.

10. The component of claim 7, wherein when installed, the rivet body directly engages the rail aperture.

11. The component of claim 7, wherein the rivet body is resilient and provides for deformation during travel of the pulley rivet within and through the rail aperture during installation.

12. The component of claim 7, wherein the rivet body is elastic and provides for deformation during travel of the pulley rivet within and through the rail aperture during installation.

* * * * *